US008857347B1

(12) United States Patent
Liu et al.

(10) Patent No.: US 8,857,347 B1
(45) Date of Patent: Oct. 14, 2014

(54) FOLDABLE HANGING TABLE

(71) Applicant: Keysheen Industry(Shanghai) Co., Ltd., Shanghai (CN)

(72) Inventors: Lausan Chung-Hsin Liu, Shanghai (CN); Shopo Hsin Tsu Liu, Shanghai (CN); Fibro Tsu Kun Liu, Shanghai (CN)

(73) Assignee: Keysheen Industry (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 14/031,345

(22) Filed: Sep. 19, 2013

(51) Int. Cl.
*A47B 5/00* (2006.01)
*A47B 5/04* (2006.01)

(52) U.S. Cl.
CPC ..... *A47B 5/04* (2013.01)
USPC ..... 108/47

(58) Field of Classification Search
CPC ..... A47B 31/06; A47B 5/02; A47B 5/04; A47B 96/02; A47B 96/028
USPC ..... 108/40, 42, 47, 48, 152; 211/90.01, 211/90.02, 96, 150; 182/187
See application file for complete search history.

(56) References Cited

U.S. PATENT DOCUMENTS

| | | | | | |
|---|---|---|---|---|---|
| 1,571,753 | A | * | 2/1926 | Christian | 108/47 |
| 3,050,355 | A | * | 8/1962 | Hess et al. | 108/9 |
| 3,129,032 | A | * | 4/1964 | Meyer et al. | 297/163 |
| 3,368,423 | A | * | 2/1968 | Fazekas et al. | 74/165 |
| 4,927,107 | A | * | 5/1990 | Mateo Maria | 248/240.4 |
| 4,942,942 | A | * | 7/1990 | Bradley | 182/187 |
| 5,458,215 | A | * | 10/1995 | Burgin | 182/187 |
| 5,469,794 | A | * | 11/1995 | Laderoute et al. | 108/48 |
| 5,653,178 | A | * | 8/1997 | Huczka | 108/47 |
| 5,722,329 | A | * | 3/1998 | Weng | 108/47 |
| 6,012,690 | A | * | 1/2000 | Cohen | 248/226.11 |
| 6,168,125 | B1 | * | 1/2001 | Winger et al. | 248/228.3 |
| 6,705,235 | B1 | * | 3/2004 | Gerutto | 108/47 |
| 6,931,998 | B1 | * | 8/2005 | Leese | 108/42 |

* cited by examiner

*Primary Examiner* — Matthew Ing
(74) *Attorney, Agent, or Firm* — Muncy, Geissler, Olds & Lowe, P.C.

(57) ABSTRACT

A foldable hanging table hung on a construction structural body with a leaning top surface comprises a table panel, a suspension assembly and a folding assembly. The suspension assembly includes a support rack hinged by the table panel and at least one suspension arm connecting to the support rack and straddling the construction structural body to lean on the leaning top surface. The folding assembly includes a swivel frame hinged on the table panel and a driven member hinged respectively on the support rack and swivel frame. The driven member includes at least one holding portion to confine the swivel frame from swiveling against the table panel and at least one driving portion connected to the holding portion and operable to make the holding portion separate from the swivel frame so that the swivel frame can swivel, thereby make folding easier and increase the support of the table panel.

16 Claims, 8 Drawing Sheets

FOLDABLE HANGING TABLE

FIELD OF THE INVENTION

The present invention relates to a hanging table and particularly to a foldable hanging table.

BACKGROUND OF THE INVENTION

Many people have paid much attention to leisure life quality and household activities nowadays. Many community gardens, backyards, public parks or house balconies often serve as people's meeting and chatting venues. To provide resting or meet visual art requirement, many of those locations have fixed table tops attached to handrails to hold potted landscapes, leisure parasols, lamp sets, teat sets or the like.

In order to provide a table top for hanging on handrail, U.S. Pat. No. 5,653,178 discloses a railing supported folding table which includes a first frame, a second frame and a table top. The table top is hinged on the first and second frames through at least one pivotal member, and then is mounted onto a handrail through a first adjustment hook and a second adjustment hook. The first and second adjustment hooks are installed respectively on through holes formed on the first and second frames, and then are fastened firmly via fasteners to securely hang the table top on the handrail. Because the table top is hinged on the first and second frames merely through the pivotal member, the pivotal member tends to loosen off after repeatedly flipping or folding of the table top for a prolonged period of time to result in incline of the table top. Moreover, with only the pivotal member serving as a support spot, when the table top is loaded with heavy goods, the support could become insufficient to result in collapse of the table top and drop of the goods.

SUMMARY OF THE INVENTION

The primary object of the present invention is to provide a hanging table that has increased table panel support and can be folded easily.

To achieve the foregoing object, the present invention provides a foldable hanging table hung on a construction structural body. The construction structural body has a leaning top surface formed at a selected width. The foldable hanging table includes a table panel, a suspension assembly and a folding assembly. The table panel has a loading surface, a connection surface opposite to the loading surface and a hinge portion. The suspension assembly includes a support rack hinged by the hinge portion of the table panel and at least one suspension arm connecting to the support rack and straddling the construction structural body to lean on the leaning top surface. The suspension arm is formed at a length at least greater than the width of the leaning top surface. The folding assembly includes a swivel frame hinged on the connection surface of the table panel and a driven member hinged respectively on the support rack and swivel frame. The driven member includes at least one holding portion to confine the swivel frame from swiveling against the table panel and at least one driving portion connected to the holding portion and operable to make the holding portion separate from the swivel frame so that the swivel frame can swivel.

In one embodiment the suspension assembly includes an anchor portion coupled by the suspension arm, an adjustment member with an aperture formed thereon and a fastener running through the aperture to tightly press against the construction structural body.

In another embodiment the suspension arm has a plurality of anchor holes equally spaced from each other. One of the anchor holes is selected according to the width of the leaning top surface to couple on the anchor portion.

In yet another embodiment the driven member includes a grip handle which allows a user to grip and exert a force towards the suspension assembly.

In yet another embodiment the swivel frame includes at least one detent plate butting the driven member to confine the swivel frame from swiveling against the driven member.

In yet another embodiment the driven member has a housing space and an elastic element held in the housing pace to provide a compression displacement to drive the holding portion of the driving portion to separate from the swivel frame.

In yet another embodiment the invention further includes a horizontal adjustment assembly which has an adjustment rack hinged on the support rack and having a butting portion leaning on the construction structural body, and a guide member having a guide track and one end hinged on the adjustment rack. The support rack has a guide boss running through the guide track and movable along the guide track to drive the adjustment rack to generate skewness.

In yet another embodiment the guide track includes at least one anchor notch to allow the guide boss to enter the guide track and skew from the axial direction of the guide track and anchor therein.

In yet another embodiment the guide member has an arched inclined portion.

In yet another embodiment the invention further includes a horizontal adjustment assembly which has an adjustment rack hinged on the support rack and having a butting portion leaning on the construction structural body, at least one horizontal retainer located on the support rack and a fine-tune member running through the horizontal retainer and butting the adjustment rack to drive the adjustment rack to generate skewness.

In yet another embodiment the adjustment rack is formed at a width greater than that of the support rack.

In yet another embodiment the horizontal retainer has a fine-tune aperture run through by the fine-tune member.

In short, the foldable hanging table of the invention mainly is hung on a leaning top surface of a construction structural body that is formed at a selected width, and includes a table panel, a suspension assembly and a folding assembly. The suspension assembly includes a support rack hinged by the table panel and at least one suspension arm connecting to the support rack and straddling the construction structural body to lean on the leaning top surface. The suspension arm is formed at a length at least greater than the width of the leaning top surface. The folding assembly includes a swivel frame hinged on the table panel and a driven member hinged respectively on the support rack and swivel frame. The driven member includes at least one holding portion to confine the swivel frame from swiveling against the table panel and at least one driving portion connected to the holding portion and operable to make the holding portion separate from the swivel frame so that the swivel frame can swivel as desired.

The foldable hanging table of the invention thus formed provides many advantages, notably:

1. The suspension arm can be adjusted according to the width of the construction structural width.
2. Support of the table panel is increased.
3. Improves usability and convenience of the folding table panel.
4. The horizontal condition of the table panel is adjustable.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
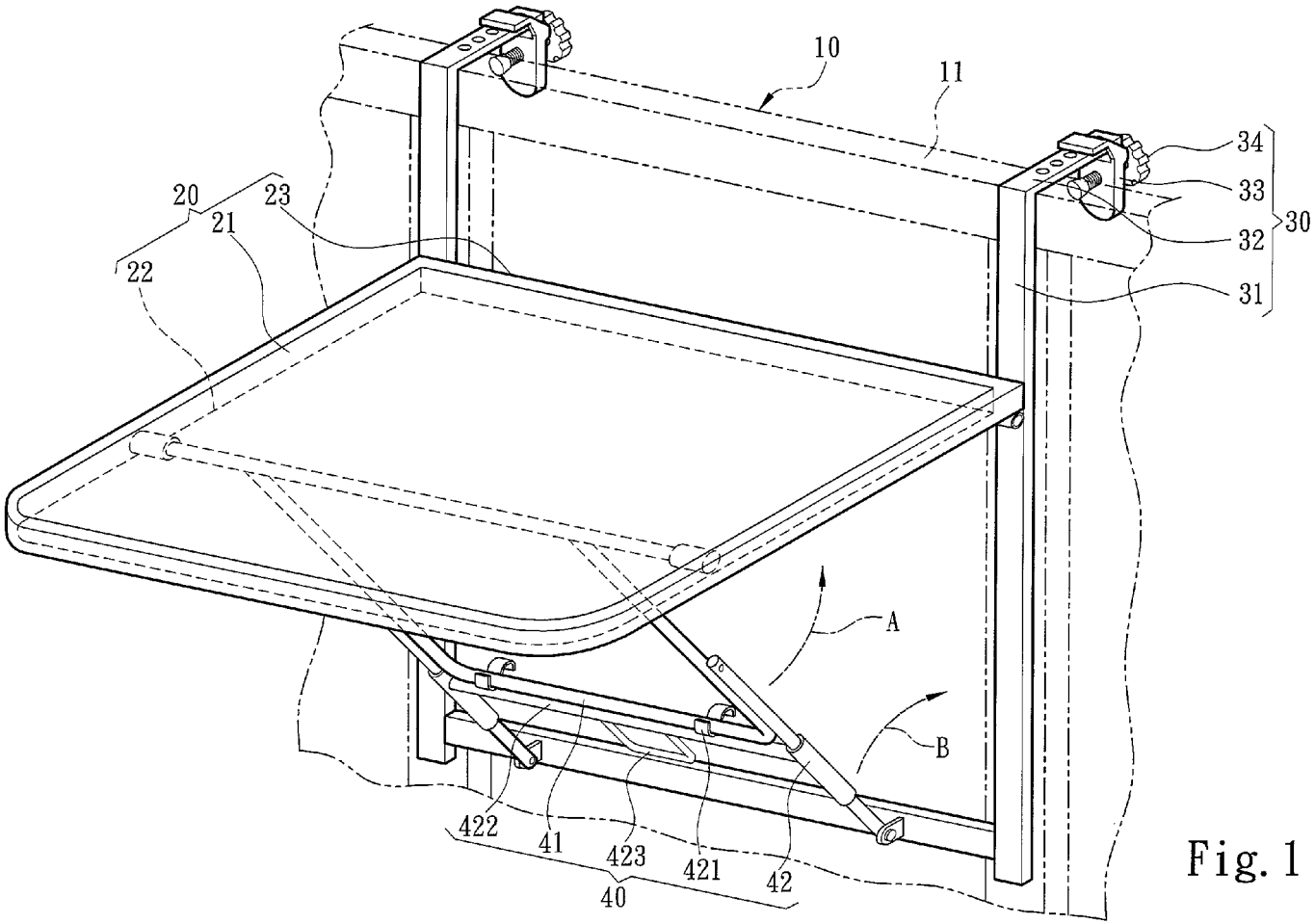
FIG. 1 is a schematic view of a first embodiment of the foldable hanging table in an assembly condition.
Figure 2:
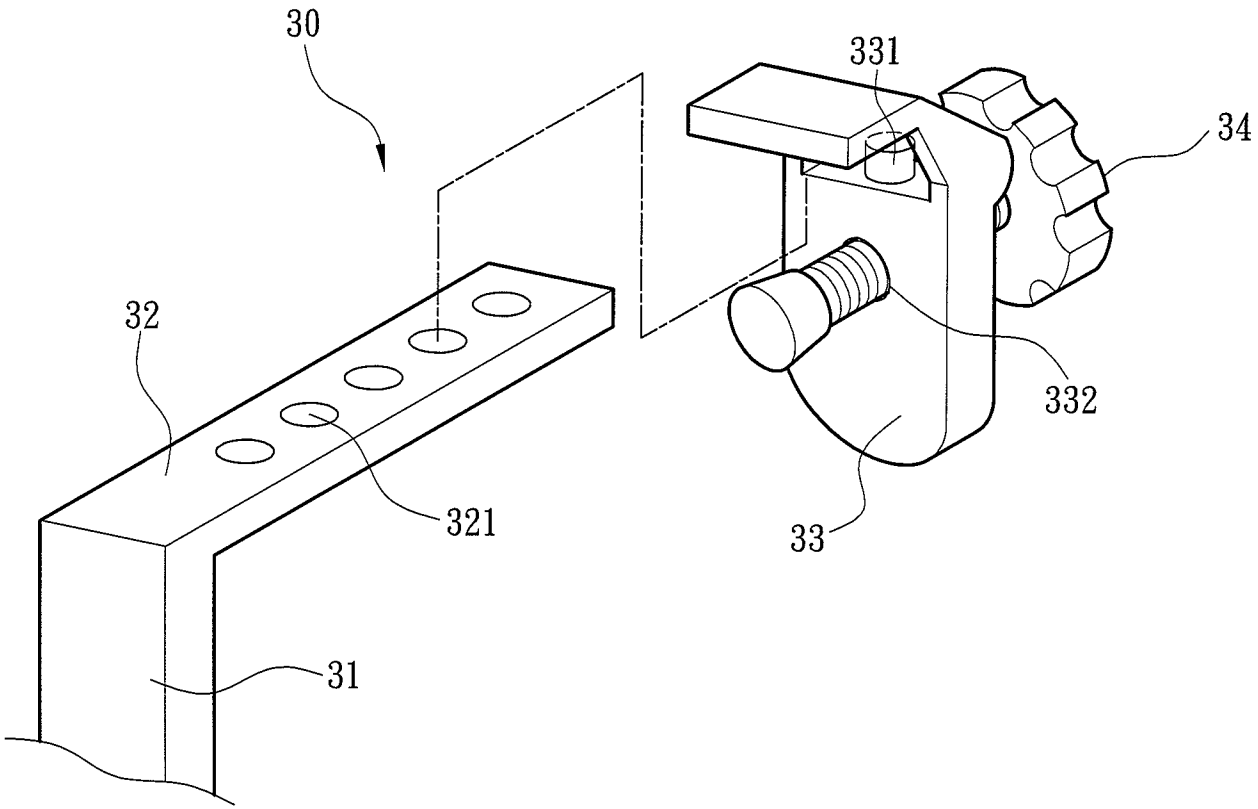
FIG. 2 is an exploded view of the suspension assembly of the invention.
Figure 3:
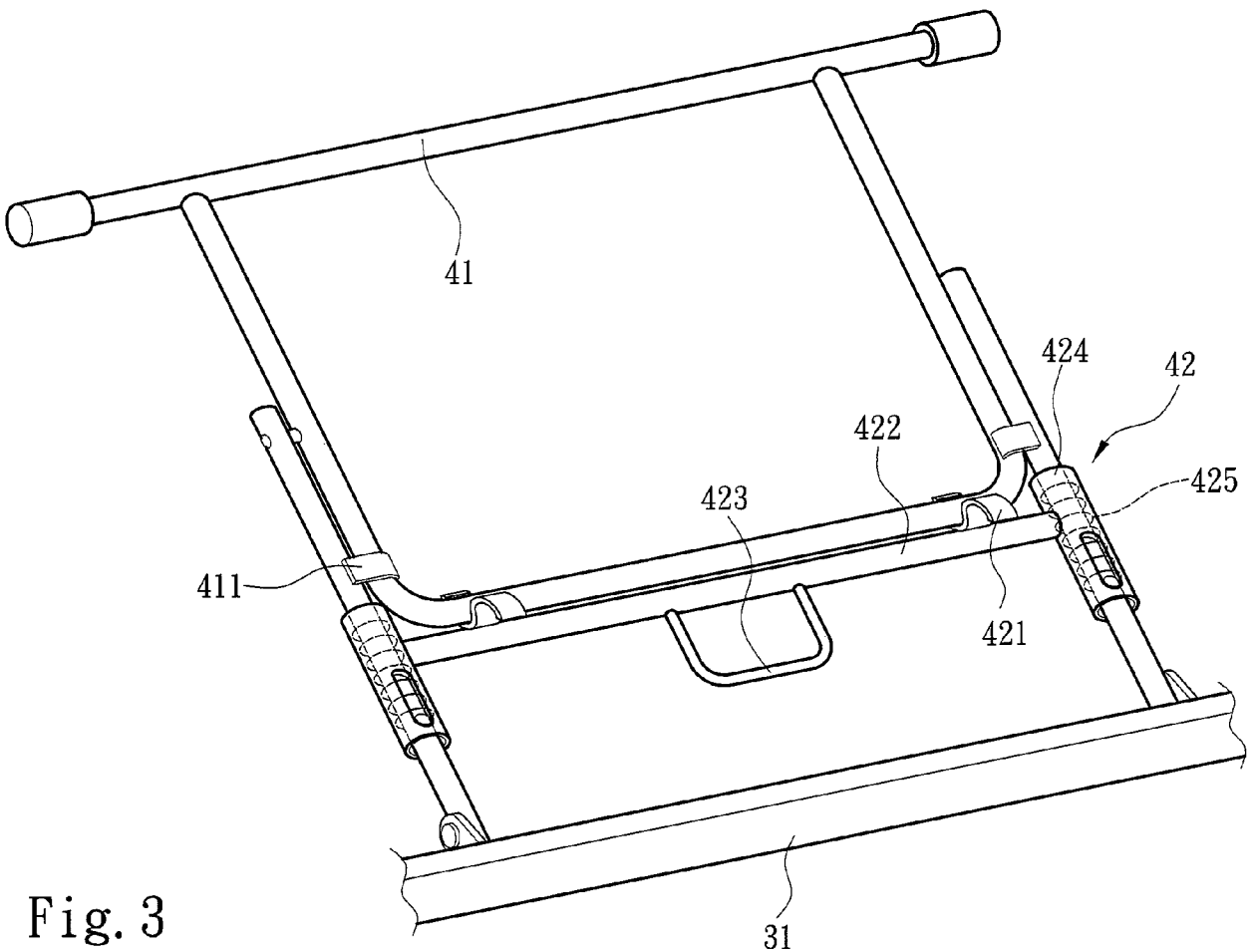
FIG. 3 is a schematic view of the folding assembly of the invention.
Figure 4:
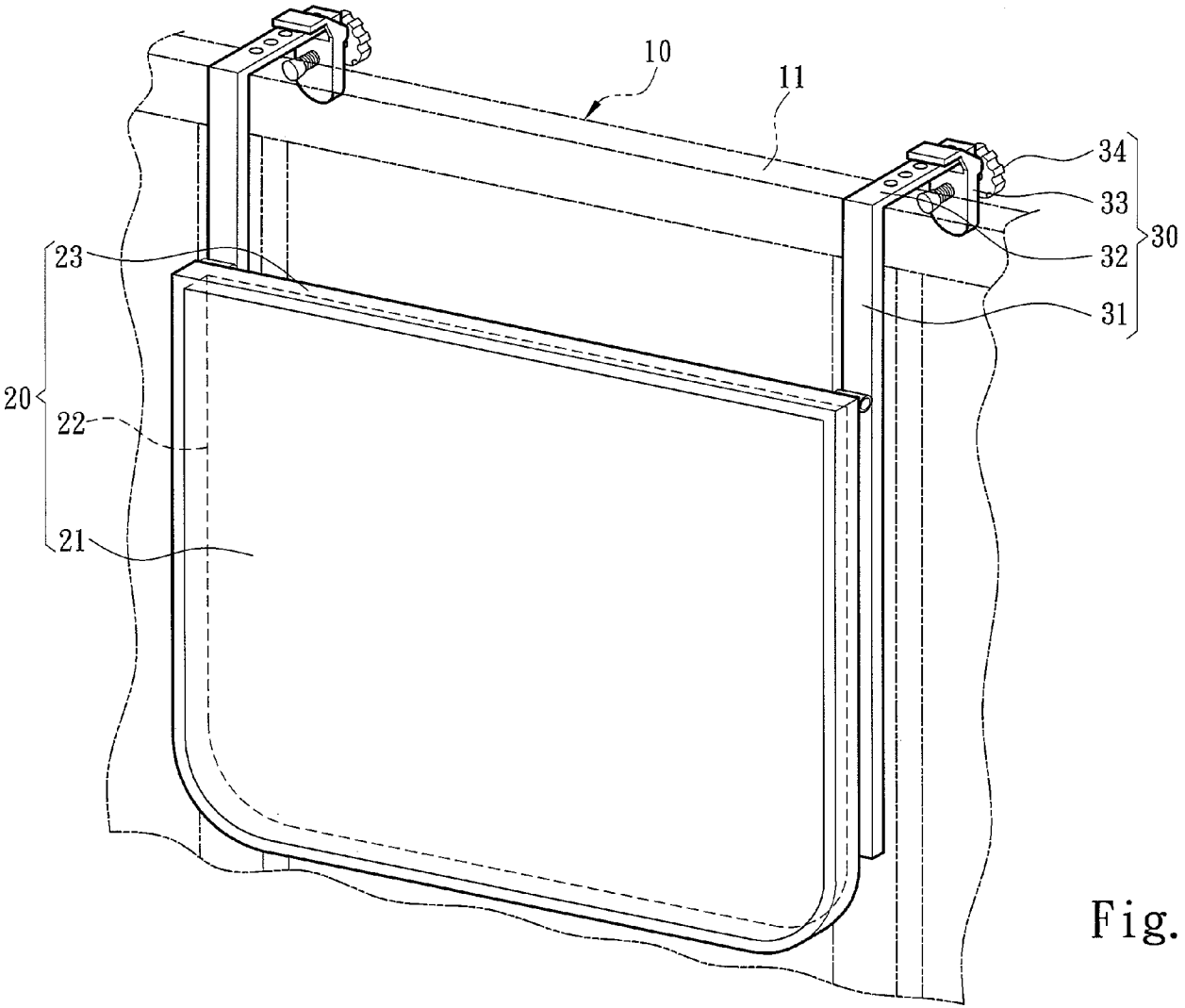
FIG. 4 is a schematic view of the first embodiment of the invention in a folding condition.

Please refer to FIGS. 1 through 4 for a first embodiment of the foldable hanging table of the invention. The foldable hanging table comprises a table panel 20, a suspension assembly 30 and a folding assembly 40 that aims to be hung on a construction structural body 10. The construction structural body 10 has a leaning top surface 11 formed at a selected width. The table panel 20 has a loading surface 21, a connection surface 22 opposite to the loading surface 21 and a hinge portion 23. The suspension assembly 30 includes a support rack 31, at least one suspension arm 32, an adjustment member 33 and a fastener 34. The support rack 31 is hinged by the hinge portion 23 of the table panel 20. The suspension arm 32 is connected to the support rack 31 and straddles the construction structural body 10 to lean on the leaning top surface 11. The suspension arm 32 is formed at a length at least greater than the width of the leaning top surface 11 and has a plurality of anchor holes 321 formed thereon and equally spaced from each other. The adjustment member 33 has an anchor portion 331 (such as an anchor strut) and an aperture 332. When the suspension arm 32 leans on the leaning top surface 11, the anchor portion 331 of the adjustment member 33 can be anchored by one of the anchor holes 321 selected according to the width of the leaning top surface 11. Then the fastener 34 can run through the aperture 332 of the adjustment member 33 to tightly press against the construction structural body 10, thereby the table panel 20 can be hung on the construction structural body 10.

The folding assembly 40 includes a swivel frame 41 and a driven member 42. The swivel frame 41 is hinged on the connection surface 22 of the table panel 20 and has at least one detent plate 411. The driven member 42 is hinged respectively on the support rack 31 and swivel frame 41, and includes at least one holding portion 421, at least one driving portion 422 and a grip handle 423. The holding portion 421 aims to confines the swivel frame 41 from swiveling against the table panel 20. The driving portion 422 is connected to the holding portion 421. The grip handle 423 is connected to the driving portion 422. The driven member 42 further has a housing space 424 and an elastic element 425 (such as a spring) held in the housing space 424 to provide a compression displacement to allow a user to grip the grip handle 423 and exert a force towards the suspension assembly 30, thereby the compression displacement provided by the elastic element 425 can drive the driving portion 422 to make the holding portion 421 separate from the swivel frame 41 so that the swivel frame 41 can swivel as desired.

In this embodiment, the foldable hanging table mainly has the hinge portion 23 of the table panel 20 hinged on the support rack 31, and then the support rack 31 straddles the construction structural body 10 via the suspension arm 32, thereby the table panel 20 is hung on the construction structural body 10. The swivel frame 41 is hinged on the connection surface 22 of the table panel 20. The holding portion 421 (such as a hook) is fixed on the swivel frame 41 to confine the swivel frame 41 from swiveling against the table panel 20. Moreover, the detent plate 411 also confines the swivel frame 41 from swiveling too much against the driven member 42. As a result, the loading surface 21 of the table panel 20 and the construction structural body 10 can be formed in an unfolding condition at a vertical angle. The table panel 20, aside from being hinged on the support rack 31, also is hinged on the swivel frame 41. Hence the support rack 31 and swivel frame 41 can serve as support means to increase the support and maintain the table panel 20 at a horizontal condition without tilting. Furthermore, a user can grip the grip handle 423 and exert a force towards the suspension assembly 30; through the compression displacement provided by the elastic element 425, the driving portion 422 is driven to make the holding portion 421 separate from the swivel frame 41, thereby the swivel frame 41 can swivel towards the connection surface 22 of the table panel 20 (i.e., the turning direction A), and the driven member 42 also can swivel towards the support rack 31 (i.e., the turning direction B) to make the loading surface 21 of the table panel 20 form a folding condition at a horizontal angle against the construction structural body 10. Through the driven member 42 driving the swivel frame 41 to swivel against the table panel 20, the table panel 20 can swivel against the support rack 31 to facilitate folding of the table panel 20, thereby improve usability.

Figure 5:
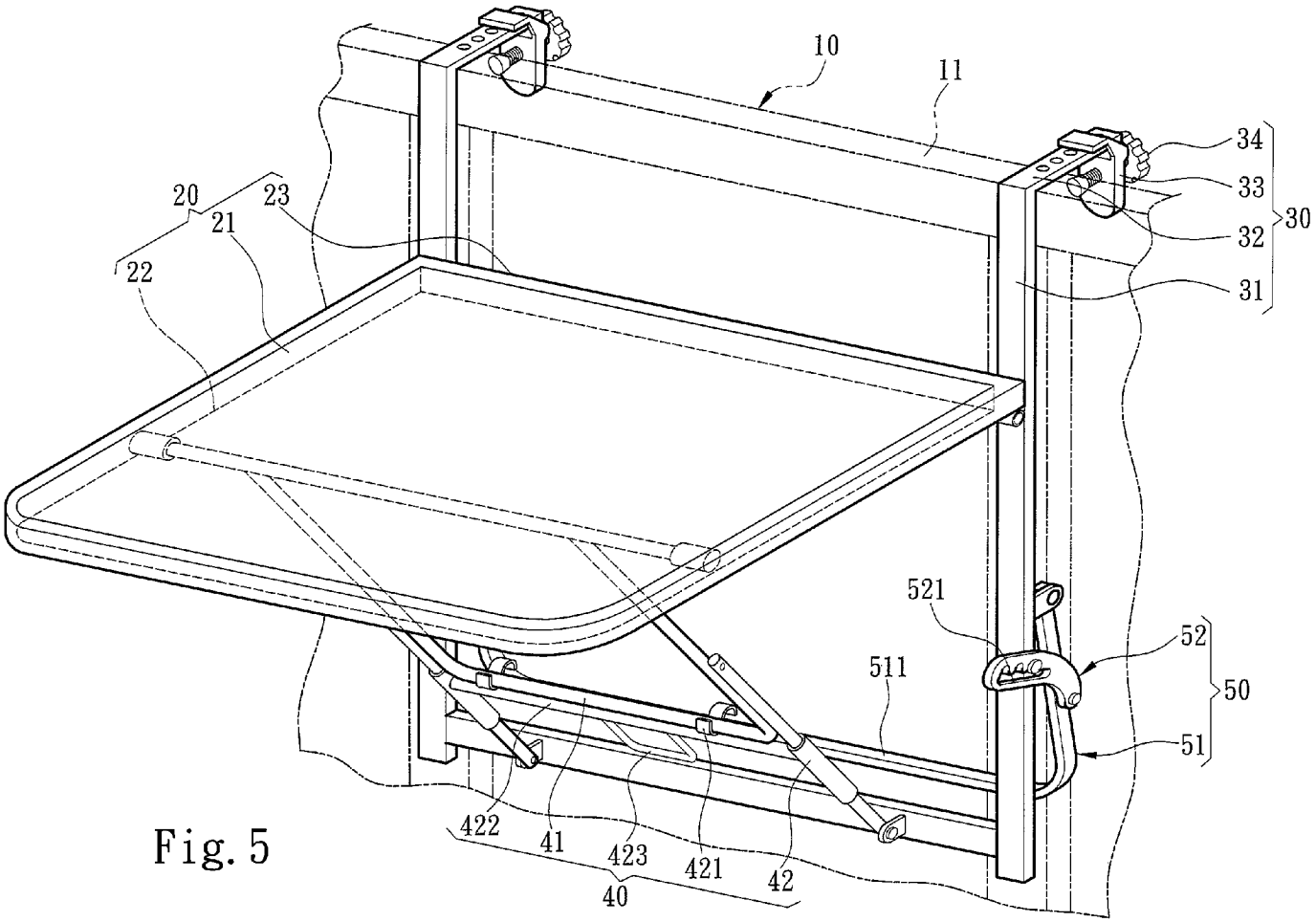
FIG. 5 is a schematic view of a second embodiment of the foldable hanging table in an assembly condition.
Figure 6:
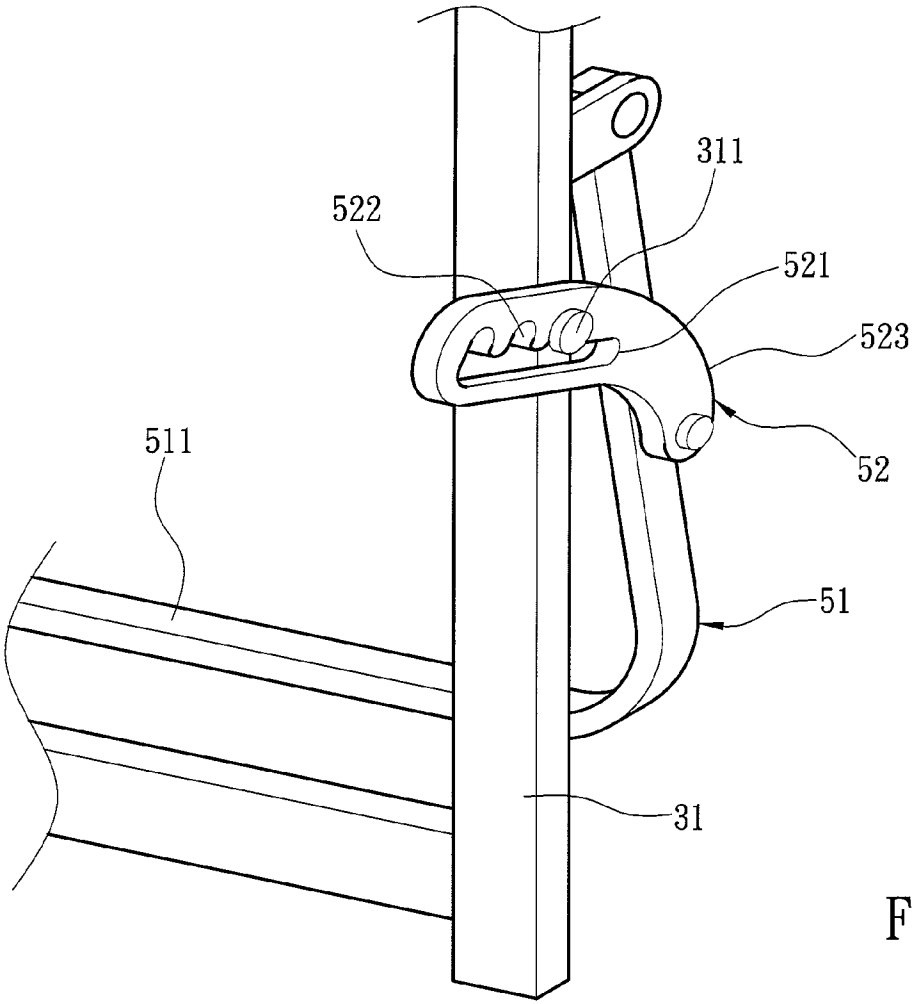
FIG. 6 is a schematic view of the horizontal adjustment assembly of the invention.

Please refer to FIGS. 5 and 6 for a second embodiment of the invention. It is substantially constructed like the first embodiment previously discussed. The main difference is a horizontal adjustment assembly 50 which includes an adjustment rack 51 and a guide member 52. The adjustment rack 51 is hinged on the support rack 31 and has a butting portion 511 leaning on the construction structural body 10. The guide member 52 has one end hinged on the adjustment rack 51 and a guide track 521 with at least one anchor notch 522 formed therein. The support rack 31 has a guide boss 311 running through the guide track 521 and movable along the guide track 521 to drive the adjustment rack 51 leaning on the construction structural body 10 to generate skewness; in addition, the guide boss 311 enters the guide track 521 and skew from the axial direction of the guide track 521 and anchor on the anchor notch 522, thereby the loading surface 21 of the table panel 20 can be adjusted at the horizontal condition, hence the tilting problem of the table panel 20 caused by different widths of the leaning top surface 11 and construction structural body 10 when the support rack 31 is hung on the construction structural body 10 can be resolved. In addition, the guide member 52 has an arched inclined portion 523 to keep the table panel 20 at the horizontal condition without tilting downward during adjustment. Moreover, it is to be noted that, the guide member 52, guide track 521 and anchor notch 522 are not limited to the structures or shapes or quantity depicted in the embodiment. The embodiment mentioned above serves merely for illustrative purpose and is not the limitation of the invention.

Figure 7:
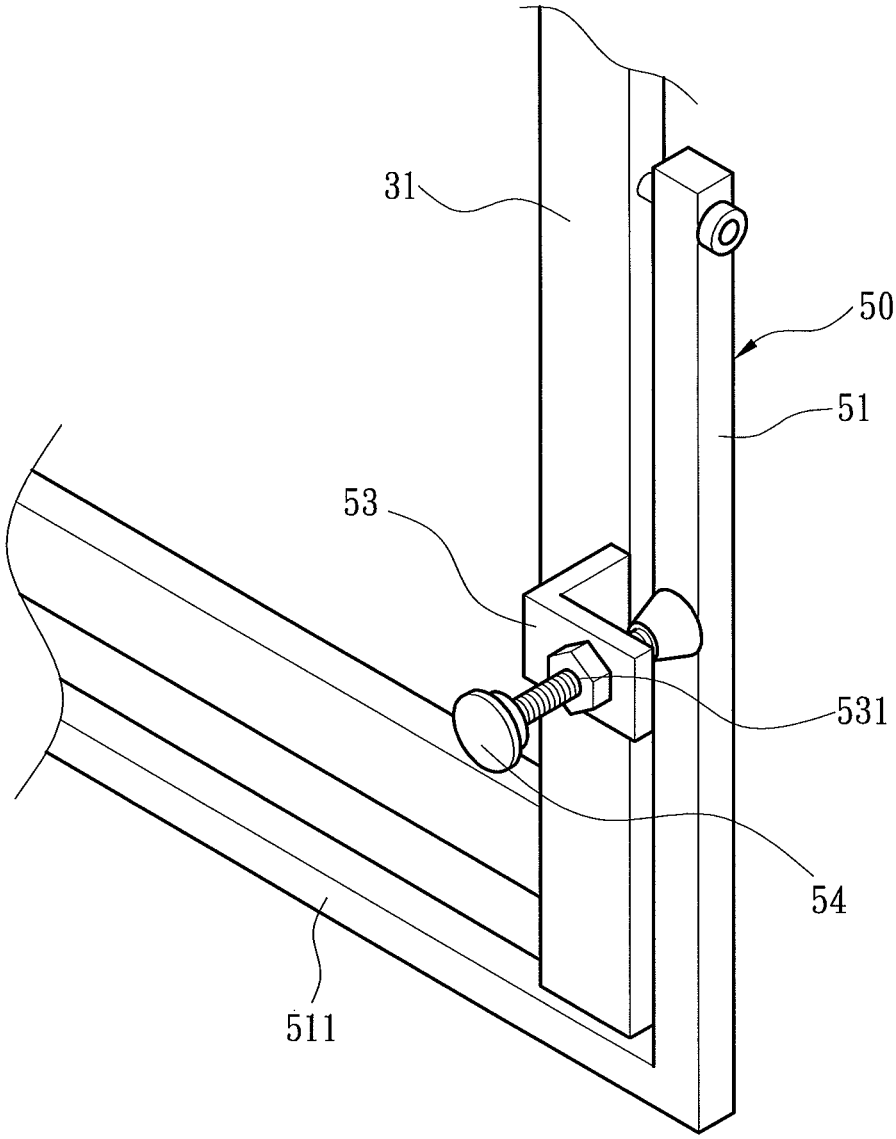
FIG. 7 is a schematic view of a third embodiment of the foldable hanging table in an assembly condition.
Figure 8:
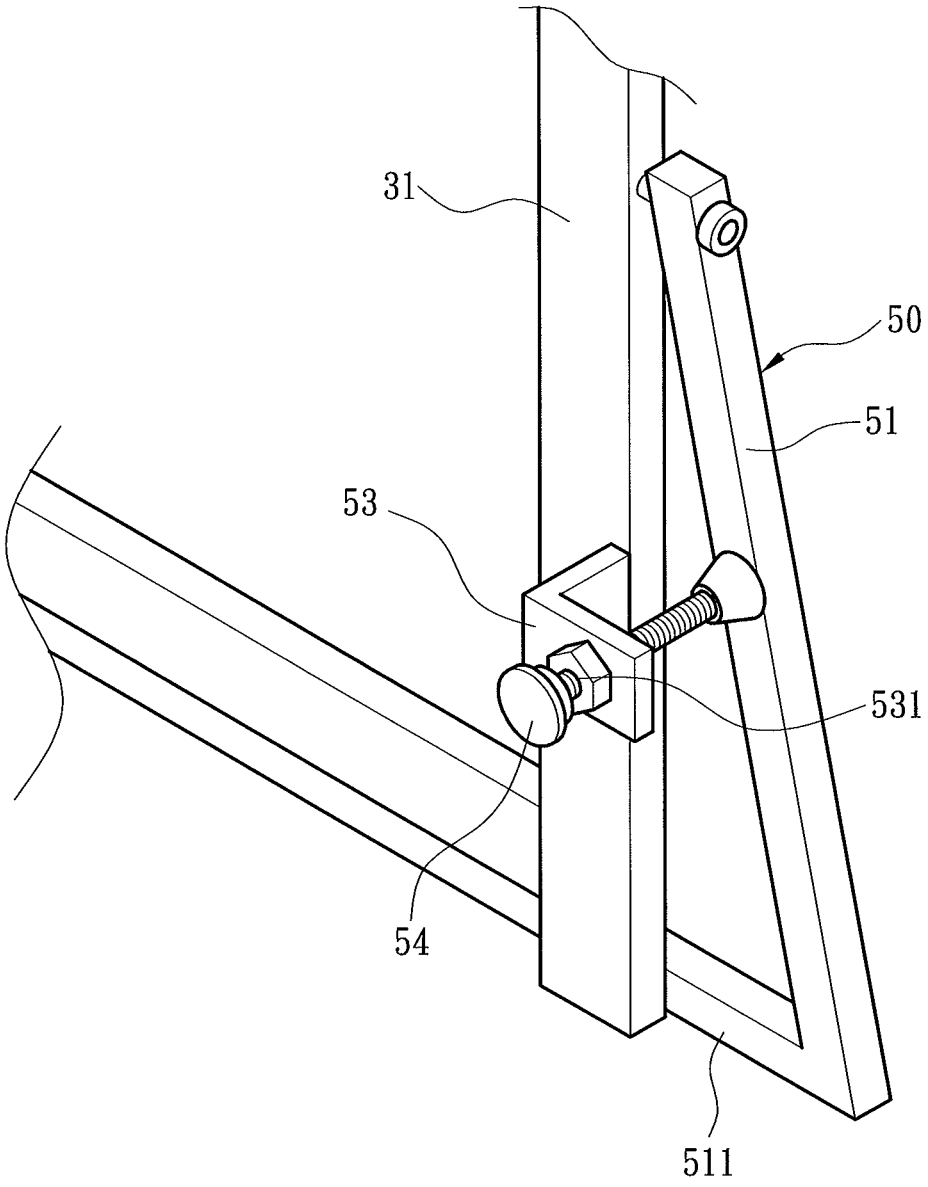
FIG. 8 is a schematic view of the horizontal adjustment assembly in the third embodiment in another assembly condition.

Please to FIGS. 7 and 8 for a third embodiment of the invention. It is substantially constructed like the first embodiment previously discussed. The main difference is a horizontal adjustment assembly 50 is added that includes an adjustment rack 51, at least one horizontal retainer 53 and at least one fine-tune member 54. The adjustment rack 51 is hinged on the support rack 31 and formed at a width greater than that of the support rack 31, and has a butting portion 511 leaning on the construction structural body 10. The horizontal retainer 53 is located on the support rack 31 and has a fine-tune aperture 531 run through by the fine-tune member 54 so that one end of the fine-tune member 54 can be turned to make another end thereof butting against the adjustment rack 51 to drive the adjustment rack 51 to generate skewness, thereby adjust the loading surface 21 of the table panel 20 at the horizontal condition, hence the tilting problem of the table panel 20 caused by different widths of the leaning top surface 11 and construction structural body 10 can be resolved. Moreover, as the width of the adjustment rack 51 is greater than that of the support rack 31, when the leaning top surface 11 and construction structural body 10 have the same width, the tilting problem does not occur. By turning one end of the fine-tune member 54, another end thereof can be loosened from the adjustment rack 51, thereby the adjustment rack 51 can be moved close to the support rack 31 to retract the support rack 31 in the adjustment rack 51; namely, the support rack 31 and adjustment rack 51 can be maintained at the same horizontal plane at a frame thickness (the thickness of the support rack 31 or the thickness of the adjustment rack 51), thereby the table panel 20 can be positioned at the horizontal condition.

In short, the foldable hanging table of the invention mainly is hung on a construction structural body with a leaning top surface formed at a selected width. The foldable hanging table comprises a table panel, a suspension assembly and a folding assembly. The suspension assembly includes a support rack hinged by the table panel and at least one suspension arm connecting to the support rack and straddling the construction structural body to lean on the leaning top surface. The suspension arm is formed at a length at least greater than the width of the leaning top surface. The folding assembly includes a swivel frame hinged on the table panel and a driven member hinged respectively on the support rack and swivel frame. The driven member includes at least one holding portion to confine the swivel frame from swiveling against the table panel and at least one driving portion connected to the holding portion and operable to make the holding portion separate from the swivel frame so that the swivel frame can swivel as desired. Thus, the suspension arm can be adjusted according to the width of the construction structural body, and also increase support and improve usability.

What is claimed is:

1. A foldable hanging table, hung on a construction structural body, which includes a leaning top surface formed at a selected width, the foldable hanging table comprising:

a table panel including a loading surface, a connection surface opposite to the loading surface and a hinge portion;

a suspension assembly including a support rack hinged by the hinge portion of the table panel and at least one suspension arm connecting to the support rack and straddling the construction structural body to lean on the leaning top surface, the suspension arm being formed at a length at least greater than the width of the leaning top surface;

a folding assembly including a swivel frame hinged on the connection surface of the table panel and a driven member hinged respectively on the support rack and the swivel frame and including at least one holding portion to confine the swivel frame from swiveling against the table panel and at least one driving portion connected to the holding portion and operable to make the holding portion separate from the swivel frame and make the swivel frame swivel; and a horizontal adjustment assembly including an adjustment rack which is hinged on the support rack and includes a butting portion leaning on the construction structural body, and a guide member which includes a guide track and one end hinged on the adjustment rack, the support rack including a guide boss running through the guide track and movable along the guide track to drive the adjustment rack to generate skewness.

2. The foldable hanging table of claim 1, wherein the suspension assembly includes an anchor portion coupled by the suspension arm, an adjustment member including an aperture and a fastener running through the aperture to tightly press against the construction structural body.

3. The foldable hanging table of claim 2, wherein the suspension arm includes a plurality of equally spaced anchor holes one of which being selectable according to the width of the leaning top surface to couple on the anchor portion.

4. The foldable hanging table of claim 1, wherein the driven member includes a grip handle to allow a user to grip and exert a force toward the suspension assembly.

5. The foldable hanging table of claim 1, wherein the swivel frame includes at least one detent plate butting the driven member to confine the swivel frame from swiveling against the driven member.

6. The foldable hanging table of claim 1, wherein the driven member includes a housing space and an elastic element held in the housing space to provide a compression displacement to drive the holding portion of the driving portion to separate from the swivel frame.

7. The foldable hanging table of claim 1, wherein the guide track includes at least one anchor notch to allow the guide boss to enter the guide track and skew from the axial direction of the guide track and anchor therein.

8. The foldable hanging table of claim 7, wherein the guide member includes an arched inclined portion.

9. A foldable hanging table, hung on a construction structural body, which includes a leaning top surface formed at a selected width, the foldable hanging table comprising:

a table panel including a loading surface, a connection surface opposite to the loading surface and a hinge portion;

a suspension assembly including a support rack hinged by the hinge portion of the table panel and at least one suspension arm connecting to the support rack and straddling the construction structural body to lean on the leaning top surface, the suspension arm being formed at a length at least greater than the width of the leaning top surface;

a folding assembly including a swivel frame hinged on the connection surface of the table panel and a driven member hinged respectively on the support rack and the swivel frame and including at least one holding portion to confine the swivel frame from swiveling against the table panel and at least one driving portion connected to the holding portion and operable to make the holding portion separate from the swivel frame and make the swivel frame swivel; and a horizontal adjustment assembly including an adjustment rack which is hinged on the support rack and includes a butting portion leaning on the construction structural body, at least one horizontal retainer located on the support rack and a fine-tune member running through the horizontal retainer and butting the adjustment rack to drive the adjustment rack to generate skewness.

10. The foldable hanging table of claim 9, wherein the adjustment rack is formed at a width greater than that of the support rack.

11. The foldable hanging table of claim 9, wherein the horizontal retainer includes a fine-tune aperture run through by the fine-tune member.

12. The foldable hanging table of claim 9, wherein the suspension assembly includes an anchor portion coupled by the suspension arm, an adjustment member including an aperture and a fastener running through the aperture to tightly press against the construction structural body.

13. The foldable hanging table of claim 12, wherein the suspension arm includes a plurality of equally spaced anchor holes one of which being selectable according to the width of the leaning top surface to couple on the anchor portion.

14. The foldable hanging table of claim 9, wherein the driven member includes a grip handle to allow a user to grip and exert a force toward the suspension assembly.

15. The foldable hanging table of claim 9, wherein the swivel frame includes at least one detent plate butting the driven member to confine the swivel frame from swiveling against the driven member.

16. The foldable hanging table of claim 9, wherein the driven member includes a housing space and an elastic element held in the housing space to provide a compression displacement to drive the holding portion of the driving portion to separate from the swivel frame.

* * * * *